United States Patent [19]

von Rybinski et al.

[11] Patent Number: 4,652,271

[45] Date of Patent: Mar. 24, 1987

[54] COAL SUSPENSION FLOWABILITY IMPROVERS

[75] Inventors: Wolfgang von Rybinski, Duesseldorf; Erna Kleiner, Gelnhausen, both of Fed. Rep. of Germany

[73] Assignee: Henkel Kommanditgesellschaft auf Aktien, Duesseldorf, Fed. Rep. of Germany

[21] Appl. No.: 734,004

[22] Filed: May 14, 1985

[30] Foreign Application Priority Data

Apr. 12, 1985 [DE] Fed. Rep. of Germany ..... 3513045

[51] Int. Cl.[4] ..... C10L 1/32

[52] U.S. Cl. ..... 44/51; 44/62

[58] Field of Search ..... 44/51, 62

[56] References Cited

U.S. PATENT DOCUMENTS 4,104,035 8/1978 Cole et al. ..... 44/51
4,282,006 8/1981 Funk ..... 44/51
4,436,528 3/1984 Schick et al. ..... 44/62
4,441,888 4/1984 Matt et al. ..... 44/51
4,488,881 12/1984 Mark ..... 44/51

OTHER PUBLICATIONS

Chemical Abstract 95:100410p (1981).
Chemical Abstract 100:24311m (1984).
"Handbook of Chemistry & Physics", 66th ed., CRC Press, p. F-110.

*Primary Examiner*—William R. Dixon, Jr.
*Assistant Examiner*—Margaret B. Medley
*Attorney, Agent, or Firm*—Ernest G. Szoke; Henry E. Millson, Jr.; Mark A. Greenfield

[57] ABSTRACT

A composition for increasing the flowability of coal slurries having more than 60% coal solids content and a method for its use. The composition comprises at least one viscosity regulator, at least one maleic acid/acrylic acid copolymer of a specific viscosity range, and optionally, at least one polysaccharide.

42 Claims, No Drawings

COAL SUSPENSION FLOWABILITY IMPROVERS

BACKGROUND OF THE INVENTION

1. Field of the Invention

This invention relates to compositions for improving the flowability of aqueous coal suspensions, and a method for the use of such compositions.

2. Statement of the Related Art

Flowable aqueous coal suspension suitable for being transported through a pipeline must have viscosities of less than 1,000 cP at shear velocities between 10 and 200 $s^{-1}$. At the same time, economic factors require a suspended coal solids content which is as high as possible. The coal contents of aqueous additive-free coal suspensions (depending on the properties of the types of coal employed) amount to a maximum to 55% by weight, since higher coal proportions result in viscosity increases and eventually in the loss of flowability. It has been known that additives containing surface active agents (tensides) and/or polymers cause the viscosity to be reduced and the flowability to be improved, thus making possible higher coal contents in the suspension.

U.S. Pat. No. 4,282,006 discloses aqueous coal slurries having coal contents of at least 60% by weight which contain an additive composition consisting of an anionic surfactant (e.g. naphthalene sulfonates, one example of which is "Lomar D") and an electrolyte (e.g. NaOH). The viscosities of the sus-pensions at 60 rpm are between 300 and 4,000 cP (aqueous Black Mesa mine coal slurry) and between 200 and 2,400 cP (aqueous West Virginia mine coal slurry).

Published Japanese patent application No. 56/57,891 describes aqueous coal slurries having coal contents of 60% by weight which contain maleic acid/acrylic acid copolymers in a concentration of 1% by weight as an additive. At an average copolymer molecular weight of 4,000, the viscosity is 1,800 cP.

Published European patent application No. 109,740 discloses aqueous coal suspensions having coal contents between 30 and 90% by weight, which contain propylene oxide/ethylene oxide block copolymer condensates of aliphatic or aromatic alcohols. The suspensions containing the polymers (independently of the coal properties) have lower viscosities than those suspensions wherein the block polymer has been replaced by sodium or calcium lignin sulfonates.

Published Japanese patent application No. 58/122,991 describes a mixture of glycerol-ethylene oxide/propylene oxide block polymer ether and tenside (e.g. sodium naphthalene sulphonate) which is added to coal suspensions having coal contents of from 50 to 80% by weight. The stability-life of the obtained suspensions was more than 4 weeks.

U.S. Pat. No. 4,441,888 describes the viscosity reduction of coal slurries using maleic acid/olefin copolymer salts, particularly the sodium salt of a maleic acid/$C_{3-12}$ olefin copolymer. The specifically named copolymers are pentene sodium maleate and diisobutylene sodium maleate.

SUMMARY OF THE INVENTION

This invention affords compositions for improving the flowability of aqueous coal suspensions (slurries) having at least a 60% by weight coal solids content, as well as methods for their use. The viscosities of the coal slurries achieved using the compositions of this invention are below 1,000 cP, thus affording sufficient flowability.

The compositions of this invention comprise (preferably consist essentially of, most preferably consist of):

(a) at least one viscosity regulator, which may be an anionic such as a naphthalene sulfonate or lignin sulfonate and/or a nonionic such as an ethylene oxide/propylene oxide block polymer;

(b) optionally, at least one polysaccharide stabilizer; and (c) at least one maleic acid/acrylic acid copolymer having a maleic:acrylic ratio of 0.5–2:1 and a specific viscosity of about 0.1 to 5 mPa.s (as determined in a 1% aqueous solution with a pH of 8 at 25° C.)

Component (b) may be present in up to 0.3% by weight, based on the coal content of the suspension, and the weight ratio of components (a+b) to component (c) is about 0.5–2:1.

The compositions of this invention may be added to a coal slurry at any time and in any manner, in an amount at least effective to improve the flowability of the slurry so that an at least 60% coal solids content slurry is transportable by pipeline, or the like.

DETAILED DESCRIPTION OF THE INVENTION

Other than in the operating examples, or where otherwise indicated, all numbers expressing quantities of ingredients, reaction conditions, or defining ingredient parameters used herein are to be understood as modified in all instances by the term "about".

More specifically, the compositions of this invention are preferably added to aqueous coal suspensions in concentrations of 0.1 to 2% by weight, most preferably 0.3 to 1.2% by weight, each based on the amount of the coal solids. The amounts of the individual components are preferably selected so that the ratio by weight of the sum of components (a) and (b) to component (c) is about 1:1.

The ethylene oxide/propylene oxide block polymers useful in the compositions as nonionic viscosity regulators have molecular weights between 1,000 and 20,000, those having molecular weights between 10,000 and 16,000 being preferred. The ethylene oxide content is at least 50% by weight, and preferably at least 70% by weight. The hydrophilic part of the block polymers consists of at least about 100 ethylene oxide units. Particularly suitable is a block copolymer marketed by BASF Wyandotte Corporation, Parsippany, N.J., under the trademark "Pluronic" F 108 which has the following characteristic data as stated in the U.S.P.N.F.: Molecular weight: 14,600 as found by hydroxyl end point determination; HLB: 27.0; ethylene oxide content: 80% by weight; the hydrophilic part consists of about 260 ethylene oxide units (i.e., there are about 54 propylene oxide units).

As anionic viscosity regulators there may be used any of the known alkali, alkaline earth and/or ammonium salts of naphthalene and/or lignin sulfonic acids. Preferred are an ammonium naphthalene sulfonate commercially available under the trademark "Lomar" D from Diamond Shamrock Corporation, Morristown, N.J., and an ammonium lignin sulfonate marketed by Lignin-Chemie, Germany, under the trademark "Hansa" AM.

The maleic acid/acrylic acid copolymers of the flowing-aid composition are preferably employed in the form of their alkali, alkaline earth and/or ammonium salts, and most preferably their sodium salts. They are obtained in a known manner by free radical-initiated copolymerization of acrylic acid with maleic acid or the inner anhydrides thereof, the ratio by weight of the maleic acid/acrylic acid being 0.5–2:1, preferably 0.5–1:1. The polymerization temperatures are between 50° C. and 200° C., preferably between 100° C. and 150° C. The number average molecular weight of the copolymers is characterized by their viscosity in aqueous solution. The maleic acid/acrylic acid copolymers generally, and their salts and especially sodium salts have specific viscosities of between 0.1 and 5 mPa.s, preferably between 0.1 and 0.5 mPa.s, and most preferably between 0.17 and 0.5 mPa.s in a 1% aqueous solution at a pH of 8 and 25° C. The characteristic data of the preferred maleic acid/acrylic acid copolymers are summarized in the following Table.

TABLE 1

Sodium salts of maleic acid/acrylic acid copolymers

| Maleic acid/Acrylic acid copolymer | Maleic acid/Acrylic acid (weight ratio) | Viscosity* (mPa · s) |
|---|---|---|
| M/A Copolymer 11-1 | 1:1 | 0.178 |
| M/A Copolymer 11-2 | 1:1 | 0.491 |
| M/A Copolymer 12-1 | 1:2 | 0.220 |
| M/A Copolymer 12-2 | 1:2 | 0.393 |

*As determined in a 1% aqueous solution at pH 8 and 25° C.

In order to prevent sedimentation of the aqueous coal suspensions during a possible storage it may be advantageous to add polysaccharides such as xanthan, guar gum and/or hydroxypropyl guar gum in concentrations of up to 0.3% by weight—based on the coal content—as stabilizers to the suspensions.

The viscosities of the aqueous coal suspensions containing the additives which were prepared by adding the invention composition into a stirred coal/water mixture were determined using the rotation viscosimeter "Rheomat" 30 (cylindrical measuring body) a trademark of the Contraves Company, at a shear rate of 40 $s^{-1}$ or using the "Epprecht" rotation viscosimeter (anchor-shaped measuring body), at a shear rate of 200 $s^{-1}$. As will be apparent from Tables 2 and 3, aqueous coal suspensions having coal solids contents of at least 64% by weight and containing anionic or nonionic viscosity regulators have viscosities in the case of naphthalene and/or lignin sulfonates (as determined with the Rheomat 30) of at least 800 cP or viscosities (as determined with the Epprecht viscosimeter) of at least 2,100 cP. For the ethylene oxide/propylene oxide block polymer a viscosity of 870 cP was measured. If the viscosity regulators are replaced by maleic acid/acrylic acid copolymers, the aqueous coal suspensions are no longer flowable.

Surprisingly it has now been found that flowing-aid compositions containing per se known anionic viscosity regulators based on at least one of naphthalene sulfonates and/or lignin sulfonates and/or nonionic viscosity regulators based on at least one of ethylene oxide/propylene oxide block polymers and optionally per se known stabilizers from the group comprising the polysaccharides in combination with maleic acid/acrylic acid copolymers cause a synergistic enhancement of the flowability of stable aqueous coal suspensions to be effected. As will be apparent from Table 2, aqueous coal suspensions having a coal content of 64% by weight which contain ammonium naphthalene sulfonate ("Lomar" D) or ammonium lignin sulfonate ("Hansa" AM) in combination with sodium maleic acid/acrylic acid copolymer in a ratio by weight of 1:1 and in a total concentration of 1% by weight, based on the weight of the coal solids, have viscosities between 600 and 750 mPa.s. In contrast thereto, coal suspensions containing only one component of the flowing-aid composition have much higher viscosities. In the case of the ammonium naphthalene sulfonate the viscosity is 800 mPa.s, and in the case of the ammonium lignin sulfonate the viscosity is 930 mPa.s. In the case of the copolymer the suspension is no longer flowable. The viscosity is reduced to the highest extent in the presence of flowing-aid compositions containing nonionic viscosity regulators in combination with maleic acid/acrylic acid copolymers.

The synergistic enhancement of the flowability which allows the coal content in the suspension to be increased and improves the economic efficiency in the transportation and subsequent direct processing of the coal has been observed with several coal types having different dispersibilities (cf. Tables 2 and 3). The Russian coal mentioned in Table 2 has a particle size of less than 200 μm, a heating value of from 6,500 to 7,000 kcal and an ash content of about 10%, and has very unfavorable dispersing properties. Coal types having a lower ash content such as the Ruhr fat coal of Table 3, having an ash content of 6.8% (particle size: 90% larger than 200 μm) have more favorable dispersing properties.

Independently of the properties of the kinds of coal the synergistic effects of the inventive compositions with respect to the reduction of the viscosity are striking for all of the coal suspensions. Coal slurries comprising additive compositions containing anionic and/or nonionic viscosity regulators in combination with maleic acid/acrylic acid copolymers in a ratio by weight of 0.5–2:1, and preferably of 1:1, have a viscosity which is as low as 50% less than that of coal slurries containing only one component—the viscosity regulator or the maleic acid/acrylic acid copolymer.

Coal slurries containing this invention's compositions are particularly well suited to continuous transportation via pipelines at low cost. Furthermore, such coal slurries may be directly combusted without prior dehydration due to lower pollutant emissions. In coal gasification using aqueous slurries, dust explosions as caused by dry finely ground coal particles are avoided.

TABLE 2

Viscosities of aqueous coal suspensions of Russian coal, determined by using a "Rheomat" 30 viscometer at 25° C. (shear rate: 40 $s^{-1}$); coal content: 64% by weight; additive concentration 1% by weight, based on coal.

| Composition (a) | Ingredient (b) | Weight Ratio of (a):(b) | Viscosity (mPa · s) | Reduction of Viscosity against using only ingredient (a) - % |
|---|---|---|---|---|
| Lomar D | | | 800 | |
| Hansa AM | | | 930 | |
| Pluronic F 108 | | | 870 | |
| | M/A copolymer 11-1 | | * | |
| | M/A copolymer 11-2 | | * | |

TABLE 2-continued

Viscosities of aqueous coal suspensions of Russian coal, determined by using a "Rheomat" 30 viscometer at 25° C. (shear rate: 40 $s^{-1}$); coal content: 64% by weight; additive concentration 1% by weight, based on coal.

| Composition (a) | Ingredient (b) | Weight Ratio of (a):(b) | Viscosity (mPa · s) | Reduction of Viscosity against using only ingredient (a) - % |
|---|---|---|---|---|
| | M/A copolymer 12-1 | | * | |
| | M/A copolymer 12-2 | | * | |
| Lomar D | M/A copolymer 11-1 | 1:1 | 750 | 6 |
| Lomar D | M/A copolymer 11-2 | 1:1 | 660 | 18.5 |
| Hansa AM | M/A copolymer 11-2 | 1:1 | 730 | 21.5 |
| Hansa AM | M/A copolymer 12-1 | 1:1 | 600 | 35.5 |
| Hansa AM | M/A copolymer 12-2 | 1:1 | 620 | 33 |
| Hansa AM | M/A copolymer 12-2 | 1:2 | 650 | 30 |
| Pluronic F 108 | M/A copolymer 11-2 | 1:1 | 430 | 50 |

*not flowable

TABLE 3

Viscosities of aqueous coal suspensions of Ruhr fat coal, determined by using an "Epprecht" viscosimeter (shear rate: 200 $s^{-1}$); additive concentration 1% by weight, based on coal.

| Composition (a) | Ingredient (b) | Weight Ratio of (a):(b) | Coal Content (% by wt.) | Viscosity (mPa · s) | Reduction of Viscosity against using only ingredient (a) - % |
|---|---|---|---|---|---|
| Lomar D | | | 70 | 2,100 | |
| Lomar D | | | 71 | 3,000 | |
| | M/A copolymer 11-1 | | 70 | * | |
| | M/A copolymer 11-2 | | 70 | * | |
| Lomar D | M/A copolymer 11-2 | 1:1 | 70 | 1,700 | 19 |
| Lomar D | M/A copolymer 11-2 | 1:2 | 70 | 1,950 | 7 |
| Lomar D | M/A copolymer 11-1 | 1:1 | 70 | 1,900 | 10 |
| Lomar D | M/A copolymer 11-2 | 1:1 | 71 | 2,200 | 27 |

*not flowable

We claim:

1. A composition for improving the flowability of aqueous coal suspensions having coal contents of at least 60% by weight consisting essentially of:
   (a) at least one viscosity regulator selected from naphthalene sulfonates, lignin sulfonates, or ethylene oxide/propylene oxide block polymers;
   (b) 0 to about 0.3% by weight, based on the coal content of the suspension, of at least one polysaccharide stabilizer; and
   (c) at least one maleic acid/acrylic acid copolymer having a maleic:acrylic weight ratio of about 0.5–2:1 and a specific viscosity of about 0.1 to 5 mPa.s as determined in a 1.% aqueous solution with a pH of 8 at 25° C.;

with the proviso that the weight ratio of components (a+b):(c) is about 0.5–2:1.

2. The composition of claim 1 wherein said naphthalene sulfonates and/or lignin sulfonates are in the form of alkali, alkaline earth, or ammonium salts and wherein said ethylene oxide/propylene oxide block polymers have molecular weights between 1,000 and 20,000.

3. The composition of claim 2 wherein said salts are ammonium salts and said molecular weights are between 10,000 and 16,000.

4. The composition of claim 1 wherein in said ethylene oxide/propylene oxide block polymers, the ethylene oxide portion comprises at least 100 ethylene oxide units and is at least 50% by weight of said block polymers.

5. The composition of claim 4 wherein said ethylene oxide portion comprises at least 70% by weight of said block polymers.

6. The composition of claim 2 wherein in said ethylene oxide/propylene oxide block polymers, the ethylene oxide portion comprises at least 100 ethylene oxide units and is at least 50% by weight of said block polymers.

7. The composition of claim 3 wherein in said ethylene oxide/propylene oxide block polymers, the ethylene oxide portion comprises at least 100 ethylene oxide units and is at least 50% by weight of said block polymers.

8. The composition of claim 1 wherein said viscosity regulator is at least one of:
   (i) an ethylene oxide/propylene oxide block polymer having a molecular weight of about 14,600, an ethylene oxide content of about 80% by weight, and about 265 ethylene oxide units as the hydrophilic portion of the polymer;
   (ii) ammonium naphthalene sulfonate; or
   (iii) ammonium lignin sulfonate.

9. The composition of claim 1 wherein said at least one maleic acid/acrylic acid copolymer is in the form of at least one alkali, alkaline earth, or ammonium salt.

10. The composition of claim 9 wherein said salt is a sodium salt.

11. The composition of claim 9 wherein said copolymer salts have specific viscosities of about 0.1 to 0.5 mPa.s.

12. The composition of claim 9 wherein said copolymer salts have specific viscosities of about 0.17 to 0.5 mPa.s.

13. The composition of claim 1 wherein the maleic:acrylic weight ratio is about 0.5–1:1.

14. The composition of claim 9 wherein the maleic:acrylic weight ratio is about 0.5–1:1.

15. The composition of claim 1 wherein the weight ratio of components (a+b):(c) is about 1:1.

16. The composition of claim 1 wherein said at least one polysaccharide is present and is xanthan, guar gum, or hydroxypropyl guar gum.

17. The composition of claim 1 wherein:

(a) said naphthalene sulfonates and/or lignin sulfonates are in the form of alkali, alkaline earth, or ammonium salts, and said ethylene oxide/propylene oxide block polymers have molecular weights of between 10,000 and 16,000 and said ethylene oxide comprises at least 50% by weight of said block polymer;

(b) said polysaccharide is at least one of xanthan, guar gum, or hydroxypropyl guar gum; and (c) said at least one maleic acid/acrylic acid copolymer is in the form of its alkali, alkaline earth, or ammonium salt, and the maleic:acrylic weight ratio is about 0.5–1:1;

with the proviso that the weight ratio of components (a+b):(c) is about 1:1.

18. The composition of claim 17 wherein said polysaccharide is present.

19. A method for improving the flowability of aqueous coal suspensions comprising adding to a suspension having a coal solids content of at least 60% by weight a flowability-improving effective amount of a composition consisting essentially of:

(a) at least one viscosity regulator selected from naphthalene sulfonates, lignin sulfonates, or ethylene oxide/propylene oxide block polymers;

(b) 0 to about 0.3% by weight based on the coal solids content of the suspension, of at least one polysaccharide stabilizer, and (c) at least one maleic acid/acrylic acid copolymer having a maleic:acrylic weight ratio of about 0.5–2:1 and a specific viscosity of about 0.1 to 5 mPa.s as determined in a 1% aqueous solution with a pH of 8 at 25° C.;

with the proviso that the weight ratio of components (a+b):(c) is about 0.5–2:1.

20. The method of claim 19 wherein said naphthalene sulfonates and/or lignin sulfonates are in the form of alkali, alkaline earth, or ammonium salts and wherein said ethylene oxide/propylene oxide block polymers have molecular weights between 1,000 and 20,000.

21. The method of claim 20 wherein said salts are ammonium salts and said molecular weights are between 10,000 and 16,000.

22. The method of claim 19 wherein in said ethylene oxide/propylene oxide block polymers, the ethylene oxide portion comprises at least 100 ethylene oxide units and is at least 50% by weight of said block polymers.

23. The method of claim 22 wherein said ethylene oxide portion comprises at least 70% by weight of said block polymers.

24. The method of claim 20 wherein in said ethylene oxide/propylene oxide block polymers, the ethylene oxide portion comprises at least 100 ethylene oxide units and is at least 50% by weight of said block polymers.

25. The method of claim 21 wherein in said ethylene oxide/propylene oxide block polymers, the ethylene oxide portion comprises at least 100 ethylene oxide units and is at least 50% by weight of said block polymers.

26. The method of claim 19 wherein said viscosity regulator is at least one of:

(i) an ethylene oxide/propylene oxide block polymer having a molecular weight of about 14,600, an ethylene oxide content of about 80% by weight and about 265 ethylene oxide units as the hydrophilic portion of the polymer;

(ii) ammonium naphthalene sulfonate; or (iii) ammonium lignin sulfonate.

27. The method of claim 19 wherein said at least one maleic acid/acrylic acid copolymer is in the form of at least one alkali, alkaline earth, or ammonium salt.

28. The method of claim 27 wherein said salt is a sodium salt.

29. The method of claim 27 wherein said copolymer salts have specific viscosities of about 0.1 to 0.5 mPa.s.

30. The method of claim 27 wherein said copolymer salts have specific viscosities of about 0.17 to 0.5 mPa.s.

31. The method of claim 19 wherein the maleic:acrylic weight ratio is about 0.5–1:1.

32. The method of claim 27 wherein the maleic:acrylic weight ratio is about 0.5–1:1.

33. The method of claim 19 wherein the weight ratio of components (a+b):(c) is about 1:1.

34. The method of claim 19 wherein said at least one polysaccharide is present and is xanthan, guar gum, or hydroxypropyl guar gum.

35. The method of claim 19 wherein:

(a) said naphthalene sulfonates and/or lignin sulfonates are in the form of alkali, alkaline earth, or ammonium salts, and said ethylene oxide/propylene oxide block polymers have molecular weights of between 10,000 and 16,000 and said ethylene oxide comprises at least 50% by weight of said block polymer;

(b) said polysaccharide is at least one of xanthan, guar gum, or hydroxypropyl guar gum; and (c) said at least one maleic acid/acrylic acid copolymer is in the form of its alkali, alkaline earth, or ammonium salt, and the maleic:acrylic weight ratio is about 0.5–1:1;

with the proviso that the weight ratio of components (a+b):(c) is about 1:1.

36. The method of claim 35 wherein said polysaccharide is present.

37. The method of claim 19 wherein said composition is added to said suspension to a concentration of about 0.1 to 2% by weight, based upon the weight of the coal solids.

38. The method of claim 19 wherein said composition is added to said suspension to a concentration of about 0.3 to 1.2% by weight, based upon the weight of the coal solids.

39. The method of claim 35 wherein said composition is added to said suspension to a concentration of about 0.1 to 2% by weight, based upon the weight of the coal solids.

40. The method of claim 36 wherein said composition is added to said suspension to a concentration of about 0.1 to 2% by weight, based upon the weight of the coal solids.

41. The method of claim 35 wherein said composition is added to said suspension to a concentration of about 0.3 to 1.2% by weight, based upon the weight of the coal solids.

42. The method of claim 36 wherein said composition is added to said suspension to a concentration of about 0.3 to 1.2% by weight, based upon the weight of the coal solids.

* * * * *